US005175138A

United States Patent [19]

Akutsu et al.

[11] Patent Number: 5,175,138

[45] Date of Patent: Dec. 29, 1992

[54] HEAT-SENSITIVE RECORDING MATERIAL

[75] Inventors: Mitsuo Akutsu; Keiji Tabata, both of Urawa, Japan

[73] Assignee: Asahi Denka Kogyo Kabushiki Kaisha, Tokyo, Japan

[21] Appl. No.: 716,233

[22] Filed: Jun. 17, 1991

[30] Foreign Application Priority Data

Jun. 22, 1990 [JP] Japan ..... 2-164817

[51] Int. Cl.[5] ..... B41M 5/30

[52] U.S. Cl. ..... 503/209; 503/208; 503/225

[58] Field of Search ..... 427/150-152; 503/208, 209, 212, 225

[56] References Cited

FOREIGN PATENT DOCUMENTS 62-90284 4/1987 Japan ..... 503/209

*Primary Examiner*—Pamela R. Schwartz

*Attorney, Agent, or Firm*—Young & Thompson

[57] ABSTRACT

A heat-sensitive recording material which comprises a color-forming layer containing a coupling substance which is usually colorless or light-colored and a developer which gives rise to color in the coupling substance upon heating. wherein the color-forming layer contains an organic phosphate, its metal salt or its basic salt of the following general formula (I):

(I)

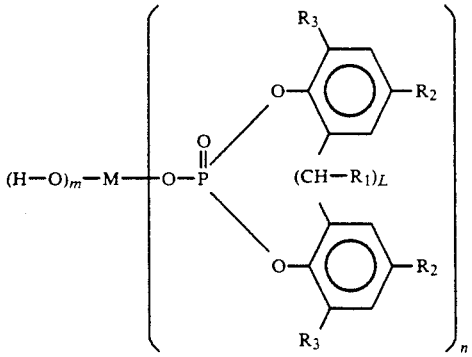

wherein $R_1$ represents a hydrogen atom or an alkyl group having 1 to 4 carbon atoms, $R_2$ and $R_3$ each represent a hydrogen atom or an alkyl group having 1 to 9 carbon atoms, M represents a hydrogen atom or a metal atom having a valence of 1 to 4, L represents 0 or 1, m, represents a number of 0 to 1, n represents 1 or 2, and m+n represents the valence of the metal M.

3 Claims, No Drawings

HEAT-SENSITIVE RECORDING MATERIAL

BACKGROUND OF THE INVENTION

1. Field of the Invention

The present invention relates to a heat-sensitive recording material. In particular, the present invention relates to a heat-sensitive recording material containing an organic phosphate of bisphenol, its metal salt or its basic salt added thereto to improve the resistance to heat, humidity and oil in the presence of a developer during storage.

2. Description of the Prior Art

Heat-sensitive recording materials consist of a heat-sensitive color-forming layer comprising a dispersion of a sensitizer, binder and other additives in a coupling system comprising a usually colorless or light-colored coupling substance such as a leuco dye and a developer which causes coloring of the coupling substance upon heating, said layer being formed on a support such as paper, synthetic paper or resin film. When a heating element such as a thermal head or hot pen is brought into contact with the recording material in a recording device, the dye is reacted with the developer to develop a color such as black to thereby form a record.

The heat-sensitive recording materials are widely used in instrumental recorders, computers, facsimiles, telex devices, automatic passenger ticket vending machines, etc., since they are superior to other recording materials in that the records can be obtained in a short time, the noise is only slight and they are inexpensive.

As the colorless or light-colored coupling substances, for example, leuco dyes having a lactone, lactam or spiropyran ring are used. As the developers, various acidic substances have been proposed heretofore. Among them, phenolic compounds such as bisphenol A and benzyl p-hydroxybenzoate are frequently used either alone or in combination of some of them. However, when these phenols are used, the printed area is whitened or the nonprinted area is colored during the storage disadvantageously. Such a phenomenon is remarkable particularly when the recording material is stored at a high temperature or in a moist atmosphere, when a fingerprint is impressed on the print or when it is brought into contact with a polyvinyl chloride sheet. Probably this is mainly due to the influence of heat, humidity or oily substance.

It is thus quite important to improve the storage stability of the heat-sensitive recording material and attempts have been made to add various third components to improve the storage stability.

For example, Japanese Patent Laid-Open Nos. 57990/1983 and 87089/1983 proposed the addition of a specified trisphenol compound in order to improve the storability; Japanese Patent Laid Open No. 185693/1984 described that the solvent resistance was improved by using a combination of an aromatic carboxylic acid with a metal salt of an aliphatic organic acid; and Japanese Patent Laid-Open No. 39593/1984 described that a combination of a phenolic developer with a metal salt of an aliphatic carboxylic acid was ineffective in improving the storability but the storability was remarkably improved by using a specified metal benzoate. Further Japanese Patent Laid-Open No. 90284/1987 described that the long-term storability can be improved by using an organic phosphonate of bisphenol.

However, the improving effects of these processes were yet insufficient and the development of a more effective process has been eagerly demanded.

SUMMARY OF THE INVENTION

After intensive investigations made for the purpose of finding an additive capable of improving the storage stability of a heat-sensitive recording material containing a developer, the inventors have found that an organic phosphate, its metal salt or its basic salt has a quite excellent effect in that the whitening of the colored area of the recording material is only slight and the fogging of the non-image area is also only slight even after storage under severe conditions. The present invention has been completed on the basis of this finding.

Thus the present invention provides a heat-sensitive recording material having an improved storability which comprises a color-forming layer containing a coupling substance which is usually colorless or light-colored and a developer which gives rise to color in the coupling substance upon heating, wherein the color-forming layer contains at least one of organic phosphates, metal salts of them and basic salts of them of the following general formula (I):

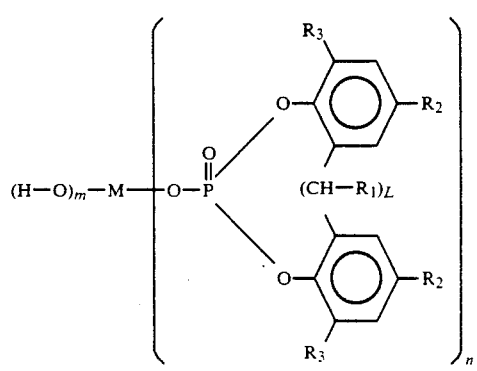

wherein $R_1$ represents a hydrogen atom or an alkyl group having 1 to 4 carbon atoms, $R_2$ and $R_3$ each represent a hydrogen atom or an alkyl group having 1 to 9 carbon atoms, M represents a hydrogen atom or a metal atom having a valence of 1 to 4, L represents 0 or 1, m represents a number of 0 to 1, n represents 1 or 2, and m+n represents the valence of the metal M.

DETAILED DESCRIPTION OF THE INVENTION

Now the detailed description will be made on the present invention the gist of which is as described above.

The alkyl group $R_1$ having 1 to 4 carbon atoms in the above formula includes methyl, ethyl, propyl, isopropyl, butyl, isobutyl, sec-butyl and tert-butyl.

The alkyl groups $R_2$ and $R_3$ include methyl, ethyl, propyl, isopropyl, butyl, isobutyl, sec-butyl, tert-butyl, amyl, tert-amyl, hexyl, octyl, isooctyl, 2-ethylhexyl, tert-octyl, nonyl, tert-nonyl, etc.

The metal atom M having a valence of 1 to 4 includes lithium, sodium, potassium, calcium, barium, magnesium, zinc, cadmium, aluminum, gallium, titanium and tin.

Typical examples of the compound of the above formula (I) used in the present invention include the following organic phosphates of bisphenol, their normal metal salts and basic salts:

No. 1

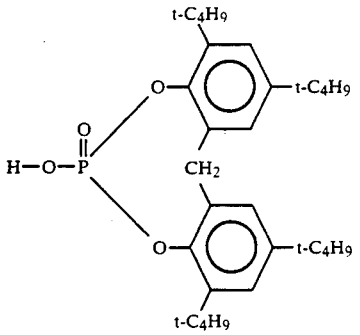

No. 2

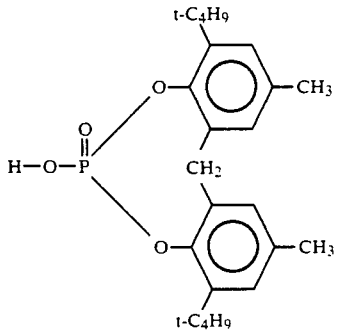

No. 3

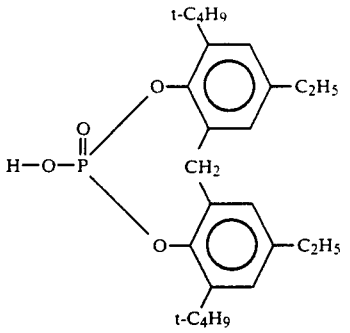

No. 4

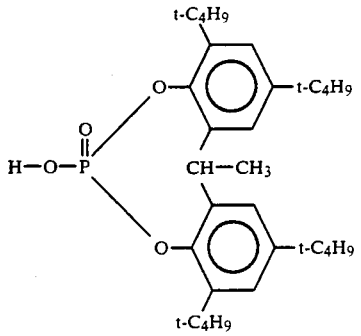

-continued

No. 5

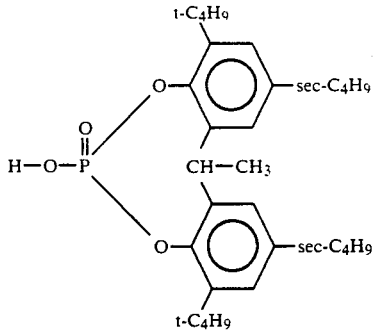

Among the metal salts and basic salts of the organic phosphates of the above formula (I), salts of Group II metals, such as zinc, calcium and magnesium salts, have a remarkable effect and are preferred.

Various dyes usable in the present invention are known as the usually colorless or light-colored coupling substances. The coupling substances used in the present invention are not particularly limited so far as they are usually used for producing ordinary pressure-sensitive recording papers or heat-sensitive recording papers.

Examples of the dyes include (1) triarylmethane compounds such as 3,3-bis(p-dimethylaminophenyl)-6-dimethylaminophthalide (Crystal Violet Lactone), 3-(p-dimethylaminophenyl)-3-(1,2-dimethyl-3-indolyl)phthalide, 3-(p-dimethylaminophenyl)-3-(2-phepyl-3-indolyl)phthalide, 3,3-bis(9-ethyl-3-carbazolyl)-5-dimethylaminophthalide and 3,3-bis(2-phenyl-3-indolyl)-5-dimethylaminophthalide;

(2) diphenylmethane compounds such as 4,4-bis(-dimethylamino)benzhydrin benzyl ether and N-2,4,5-trichlorophenylleucoauramine;

(3) xanthene compounds such as Rhodamine-$\beta$-anilinolactam, 3-dimethylamino-7-methoxyfluoran, 3-dimethylamino-6-methoxyfluoran, 3-dimethylamino-7-chlorofluoran, 3-diethylamino-6-methyl-7-chlorofluoran, 3-diethylamino-6-methyl-7-xylidlnofluoran, 3-diethylamino-6-methyl-7-anilinofluoran, 3-diethylamino-6-chloro-7-($\beta$-ethoxyethylamino)fluoran, 3-diethylamino-6-chloro-7-anilinofluoran, 3-diethylamino-6-chloro-7-$\gamma$-chloropropylaminofluoran, 3-diethylamino-6,7-dimethylfluoran, 3-diethylamino-7-methoxyfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofloran, 3-diethylamino-7-octylaminofluoran, 3-diethylamino-7-(2-chloroanilino)fluoran, 3-diethylamino-7-(2-carbomethoxyphenylamino)fluoran, 3-dibutylamino-6-methyl-7-anilinofluoran, 3-dibytylamino-7-(2-chloroanilino)fluoran, 3-dibutylamino-7-(2-fluoroanilino)fluoran, 3-(N-methyl-N-n-amylamino)-6-methyl-7-anilinofluoran, 3-(N-methyl-N-propylamino)-6-methyl-7-anilinofluoran, 3-(N-methyl-N-n-hexylamino)-6-methyl-7-anilinofluoran, 3-(N-methyl-N-cyclohexylamino)-6-methyl-7-anilinofluoran, 3-(N-ethyl-p-toluidino)-6-methyl-7-(p-toluidino)-fluoran, 3-(N-ethyl-p-toluidino)-7-methylfluoran, 3-(N-ethyl-p-toluidino)-6-methyl-7-anilinofluoran, 3-(N-ethyl-N-isoamylamino)-6-methyl-7-anilinofluoran, 3-(N-ethyl-N-n-amylamino}-6-methyl-7-anilinofluoran, 3-(N-ethyl-N-n-hexylamino)-6-methyl-7-anilinofluoran, 3-(N-ethyl-N-β-ethyl-hexylamino)-6-methyl-7anilinofluoran, 3-(N-ethyl-N-tetrahydrofurfurylamino)-6-methyl-7-anilinofluoran, 3-piperidino-6-methyl-7-anilinofluoran, 3-pyrrolidino-6-methyl-7-anilinofluoran and 3-pyrrolidino-6-methyl-7-p-butylphenylaminofluoran;

(4) thiazine compounds such as benzoyl leuco methylene blue and p-nitrobenzoyl leuco methylene blue; and (5) spiro compounds such as 3-methyl-spirodinaphthopyran, 3-ethylspirodinaphthopyran, 3-benzylspirodinaphthopyran and 3-methylnaphtho(3-methoxybenzo)spiropyran. These dyes can be used either singly or in the form of a mixture of two or more of them.

The developers usable in the present invention include phenols such as p-octylphepol, p-tert-butylphenol, p-phenylphenol, p-hydroxyacetophnone, α-naphthol, β-naphthol, p-tert-octylcatechol, 2,2'-dihydroxybiphenyl, bisphenol A, 1,1-bis(p-hydroxyphenyl)-butane, 2,2-bis(4-hydroxyphenyl)heptane, 2,2-bis(3-methyl-4-hydroxyphepyl)propane, 2,2-bis(3,5-dimpthyl-4-hydroxyphenyl)propane, 2,2-bis(3,5-dichloro-4-hydroxyphenyl)propane, bis(4-hydroxyphenyl) sulfone, bis(3,4-dihydroxyphenyl) sulfone, bis(3-allyl-4-hydroxyphenyl) sulfone, 4-hydroxy-4'-isopropoxydiphenyl sulfone, thiobis(4-hydroxy-3-tert-butyl-6-methylbenzene), 1,1-bis(4-hydroxyphenyl)cyclohexane, bis(4-hydroxyphenyl) ether, p-hydrorybenzoic acid, ethyl p-hydroxybenzoate, butyl p-hydroxybenzqate, benzyl p-hydroxybenzoate, butyl bis(4-hydroxyphenyl)acetate, 1,1,3-tris(2-methyl-4-hydroxy-5-tert-butylphenyl)butane, 1,1,3-tris(2-methyl-4-hydroxy-5-cyclohexylphenyl)butan bis[2-(4-hydroxyphenylthio)ethoxy]methane and dimethyl 4-hydroxyphthalage; aliphatic carboxylic acids such as oxalic, maleic, tartaric, citric, succinic, stearic and behenic acids; aromatic carboxylic acids such as benzoic, tert-butylbenzoic, phthalic, gallic, salicylic, isopropylsalicylic, phenylsalicylic, 3,5-di-tert-butylsalicylic, 3-methyl-5-benzylsalicylic, 3,5-di(α-methylbenzyl)salicylic and 3-phenyl-5-(β,β-dimethylbenzyl)salicylic acids and polyvalent metal salts of these carboxylic acids, such as zinc, magnesium, aluminum, calcium, titanium, manganese, tin and nickel salts of them; and inorganic developers such as acid clay, activated clay, attapulgite, bentonite, colloidal silica, aluminum silicate, magnesium silicate, zinc silicate, tin silicate, calcined kaolin and talc.

An ordinary sensitizer may also be added to the heat-sensitive recording material of the present invention. The sensitizers include heat-melting substances having a melting point of 60 to 200° C., such as 2,6-isopropylnaphthalene, 2,3,6-trimethyl-naphthalene, 2,3-dimethylnaphthalene, 1,2,3,4-tetramethylnaphthalene, 4-benzylbiphenyl, m-terphenyl, 1,2-bis(4-methylphenyl)ethane, 1,2-bis(2,3-dimethylphenyl)ethane, 1,2-bis(3,4-dimethyl-phenyl)ethane, 1,2-bis(2,4,5-trimethylphenyl)ethane, dibenzyl terephthalate, methylene dibenzoate, 1,2-bis(3-methylphenoxy)ethane, 1,4-bis(benzyloxy)benzene, 8-benzyloxynaphthalene, dibenzyl oxalate, di(p-methylbenzyl) oxalate, phenyl α-hydroxy-β-naphthalate and stearamide.

The organic phosphate of bisphenol, its metal salt or its basic salt compound used in the present invention is finely ground to an average particle diameter of 10 μm or less, still preferably 3 μm or less with a grinding machine such as a ball mill, attritor or sand grinder or a suitable emulsifier.

Further a coupling colorless dye, developer, sensitizer and various additives as required are finely ground with an apparatus similar to that described above and incorporated into the composition to give the coating fluid.

The coating fluid usually contains a binder such as polyvinyl alcohol, hydroxyethylcellulose, methylcellulose, polyacrylamide, starch, styrene/ maleic anhydride copolymer, vinyl acetate/maleic anhydride copolymer, styrene/butadiene copolymer or modifications of them, and a filler such as silica, kaolin, diatomaceous earth, talc, titanium dioxide, calcium carbonate, magnesium carbonate, aluminum hydroxide or melamine.

Further the above-described sensitizers, waxes, light stabilizers, waterproofing agents, dispersants and antifoaming agents can also be used.

The coating fluid is applied to paper or various films to form the intended heat-sensitive recording material.

The amount of the organic phosphate of bisphenol, its metal salt or its basic salt compound used in the present invention is not particularly limited, since it varies depending on the necessitated properties, suitability for the recording, and the kinds and amounts of other additives used. However, it is usually 0.1 to 10 parts by weight per part by weight of the coupling dye.

Examples

The following Examples will further illustrate the present invention, which by no means limit the invention.

Example 1

20 g of 3-(N-ethyl-N-isoamylamino)-6-methyl-7-anilinofluoran and 100 g of a 10% aqueous polyvinyl alcohol solution were sufficiently milled to give a dye dispersion (dispersion A).

20 g of benzyl 4-hydroxybenzoate and 100 g of a 10% aqueous polyvinyl alcohol solution were sufficiently milled to give a developer dispersion (dispersion B).

20 g of 1,2-bis(3-methylphenoxy)ethane and 100 g of a 10% aqueous polyvinyl alcohol solution were sufficiently milled to give a sensitizer dispersion (dispersion C).

20 g of a sample compound and 100 g of a 10% aqueous polyvinyl alcohol solution were sufficiently milled to give a storage stabilizer dispersion (dispersion D).

The dispersions A, B, C and D and finely pulverized silica were mixed in a weight ratio of 1:2:2:0.6:0.5 and well dispersed to give a coating fluid.

The coating fluid was applied to a paper support (basis weight: 50 g/m$^2$) to form a layer having a thickness of 32 μm, which was dried to give a heat-sensitive recording material.

After printing on the heat-sensitive paper thus obtained while the pulse width was fixed at 0.7 msec with a thermal printer (TH-PMD; mfd. by Ohkura Electric Co., Ltd.), the color density of the recorded image was determined with a Macbeth densitometer (RD-933; mfd. by Macbeth Co.).

Then the colored heat-sensitive paper was kept at 60° C. under a dry condition for 4 h and then at 60° C. at a relative humidity of 90% for 4 h to evaluate the density change in the non image area and in the colored area to thereby evaluate the storage stability. The results are given in Table 1.

TABLE 1

| No. | | Sample compound | Initial density non-image area | Initial density printed area | Density after dry heat storage non-image area | Density after dry heat storage printed area | Density after wet het storage non-image area | Density after wet het storage printed area |
|---|---|---|---|---|---|---|---|---|
| Comp. Ex. | 1-1 | 2,2'-methylenebis(4,6-di-tert-butylphenyl)-phosphonate | 0.09 | 1.41 | 0.17 | 0.77 | 0.40 | 1.31 |
| | 1-2 | zine distearyl phosphate | 0.10 | 1.43 | 0.18 | 0.76 | 0.18 | 0.82 |
| Example | 1-1 | compound No. 1 | 0.11 | 1.42 | 0.14 | 1.21 | 0.13 | 1.23 |
| | 1-2 | Zn salt of compound No. 1 | 0.11 | 1.41 | 0.14 | 1.30 | 0.14 | 1.24 |
| | 1-3 | basic Zn salt of compound No. 1 | 0.10 | 1.42 | 0.14 | 1.38 | 0.13 | 1.25 |
| | 1-4 | Ca salt of compound No. 1 | 0.11 | 1.40 | 0.15 | 1.27 | 0.15 | 1.21 |
| | 1-5 | Mg salt of compound No. 1 | 0.12 | 1.40 | 0.14 | 1.37 | 0.15 | 1.20 |
| | 1-6 | Na salt of compound No. 1 | 0.12 | 1.40 | 0.15 | 1.21 | 0.15 | 1.10 |
| | 1-7 | basic Al salt of compound No. 1 | 0.12 | 1.40 | 0.14 | 1.30 | 0.14 | 1.11 |
| | 1-8 | Zn salt of compound No. 2 | 0.11 | 1.41 | 0.15 | 1.30 | 0.14 | 1.20 |
| | 1-9 | Mg salt of compound No. 2 | 0.12 | 1.40 | 0.14 | 1.31 | 0.14 | 1.23 |
| | 1-10 | Zn salt of compound No. 3 | 0.11 | 1.41 | 0.15 | 1.31 | 0.14 | 1.20 |
| | 1-11 | Mg salt of compound No. 3 | 0.12 | 1.40 | 0.14 | 1.32 | 0.13 | 1.20 |
| | 1-12 | Zn salt of compound No. 4 | 0.12 | 1.42 | 0.14 | 1.35 | 0.13 | 1.23 |
| | 1-13 | Mg salt of compound No. 4 | 0.12 | 1.41 | 0.15 | 1.26 | 0.14 | 1.20 |
| | 1-14 | Zn salt of compound No. 5 | 0.11 | 1.42 | 0.14 | 1.28 | 0.13 | 1.25 |
| | 1-15 | Mg salt of compound No. 5 | 0.11 | 1.40 | 0.14 | 1.30 | 0.15 | 1.21 |

EXAMPLE 2

20 g of 3-dibutylamino-6-methyl-7-anilinofluoran and 100 g of a 10% aqueous polyvinyl alcohol solution were sufficiently milled to give a dye dispersion (dispersion A).

20 g of bisphenol A and 100 g of a 10% aqueous polyvinyl alcohol solution were sufficiently milled to give a developer dispersion (dispersion B). 20 g of 1,2-bis(3-methylphenoxy)ethane and 100 g of a 10% aqueous polyvinyl alcohol solution were sufficiently milled to give a sensitizer dispersion (dispersion C). 20 g of a sample compound and 100 g of a 10% aqueous polyvinyl alcohol solution were sufficiently milled to give a storage stabilizer dispersion (dispersion D).

The dispersions A, B, C and D and finely pulverized silica were mixed in a weight ratio of 2:2:0.6:0.5 and well dispersed to give a coating fluid.

The coating fluid was applied to a paper support (basis weight: 50 g/m$^2$) to form a layer having a thickness of 32 μm, which was dried to give a heat-sensitive recording material.

After printing on the heat-sensitive paper thus obtained while the pulse width was fixed at 0.7 msec with a thermal printer (TH-PMD; mfd. by Ohkura Electric Co., Ltd.), the color density of the recorded image was determined with a Macbeth densitometer (RD-933; mfd. by Macbeth Co.). Then the colored heat-sensitive paper was kept at 60° C. under a dry condition for 4 h and then at 60° C. at a relative humidity of 90% for 4 h to examine the density change in the colored area to thereby evaluate the storage stability.

A polyvinyl chloride resin wrapping film was applied to the colored area and kept at 60° C. under a dry condition for 4 h to examine the density change thereof to thereby evaluate the resistance to plasticizers.

The results are given in Table 2.

TABLE 2

| No. | Sample compound | Initial density | Density after storage dry heat | Density after storage wet heat | Resistance to plasticizer |
|---|---|---|---|---|---|
| Comp. Ex. | | | | | |
| 2-1 | 2,2'-methylenebis(4,6-di-tert-butylphenyl)phosphonate | 1.45 | 1.00 | 0.70 | 0.70 |
| 2-2 | zinc distearyl phosphate | 1.43 | 1.06 | 0.84 | 0.84 |
| Example | | | | | |
| 2-1 | Zn salt of compound No. 1 | 1.47 | 1.30 | 1.19 | 1.20 |
| 2-2 | Zn salt of compound No. 2 | 1.48 | 1.29 | 1.20 | 1.17 |
| 2-3 | Zn salt of compound No. 3 | 1.48 | 1.31 | 1.21 | 1.16 |
| 2-4 | Zn salt of compound No. 4 | 1.45 | 1.23 | 1.16 | 1.11 |
| 2-5 | Zn salt of comopund No. 5 | 1.43 | 1.20 | 1.12 | 1.06 |

EXAMPLE 3

Heat-sensitive recording materials were produced in the same manner as that of Example 2 except that 1,2-bis(3,4-dimethylphenyl)ethane (Example 3-1) or 4-phenylphenyl methaerylate (Example 3-2) was used as the sensitizer and zinc 2,2'-methylenebis(4,6-di-t-butylphenyl)phosphate was used as the storage stabilizer.

The same test as that of Example 2 was conducted by using the heat-sensitive paper thus produced.

The results are given in Table 3.

TABLE 3

| | | | No. 3-1 | No. 3-2 |
|---|---|---|---|---|
| Density | initial | | 1.47 | 1.45 |
| | after storage | dry heat | 1.35 | 1.30 |
| | | wet heat | 1.36 | 1.21 |

EXAMPLE 4

Heat-sensitive recording materials were produced in the same manner as that of Example 2 except that each of the compounds listed in Table 4 was used as the developer and magnesium 2,2'-methylenebis(4,6-di-t-butylphenyl) phosphate (in each Example) or 2,2'-methylenebis(4,6-di-t-butylphenyl)phosphonate (in each Comparative Example was used as the storage stabilizer.

After printing on the heat-sensitive paper thus obtained while the pulse width was fixed at 0.7 msec with a thermal printer (TH-PMD; mfd. by Ohkura Electric Co., Ltd.), the color density of the recorded image was determined with a Macbeth densitometer (RD-933; mfd. by Macbeth Co.).

Then the colored heat-sensitive paper was kept at 60° C. under a dry condition for 4 h and then at 60° C. at a relative humidity of 90% for 4 h to examine the density change in the colored area to thereby evaluate the storage stability.

The results are given in Table 4.

TABLE 4

| Developer used and No. | Initial density | | Density of printed area after storage | |
|---|---|---|---|---|
| | non-image area | printed area | dry heat | wet heat |
| [4,4'-Thiobis(2-t-butyl-5-methylphenol] | | | | |
| Example 4-1 | 0.06 | 1.38 | 1.08 | 0.96 |
| Comp. Ex. 4-1 | 0.06 | 1.32 | 0.49 | 0.34 |
| [4,4'-Sulfobisphenol] | | | | |
| Example 4-2 | 0.06 | 1.42 | 1.25 | 1.18 |
| Comp. Ex. 4-2 | 0.07 | 1.40 | 0.63 | 0.57 |
| [4,4'-Sulfobis(2-allylphenol)] | | | | |
| Example 4-3 | 0.07 | 1.40 | 1.24 | 1.13 |
| Comp. Ex. 4-3 | 0.07 | 1.41 | 0.52 | 0.45 |
| [4-Hydroxy-4'-isopropoxydiphenyl sulfone] | | | | |
| Example 4-4 | 0.06 | 1.35 | 1.17 | 1.12 |
| Comp. Ex. 4-4 | 0.07 | 1.35 | 0.49 | 0.34 |
| [1,5-Bis(4-hydroxyphenylthio)-3-oxaheptane] | | | | |
| Example 4-5 | 0.06 | 1.45 | 1.29 | 1.25 |
| Comp. Ex. 4-5 | 0.06 | 1.44 | 0.73 | 0.58 |
| [Benzyl p-hydroxybenzoate] | | | | |
| Example 4-6 | 0.07 | 1.22 | 1.06 | 0.77 |
| Comp. Ex. 4-6 | 0.07 | 1.27 | 0.44 | 0.14 |

As described above, it is apparent that when an organic phosphate of bisphenol, its metal salt or its basic salt is incorporated into a heat-sensitive recording material according to the present invention, the fading in the colored area after the dry heat or wet heat storage is inhibited, an excellent resistance to plasticizers is exhibited and, in addition, the fogging of the non-image area is scarcely caused, so that they are quite excellent storage stabilizers for the heat-sensitive recording material.

What is claimed is:

1. A heat-sensitive recording material deposited on a substrate which comprises a color-forming layer containing a coupling substance which is colorless or light-colored and a developer which gives rise to color in the coupling substance upon heating, wherein the color-forming layer contains an organic phosphate, its metal salt or its basic salt of the following general formula (I):

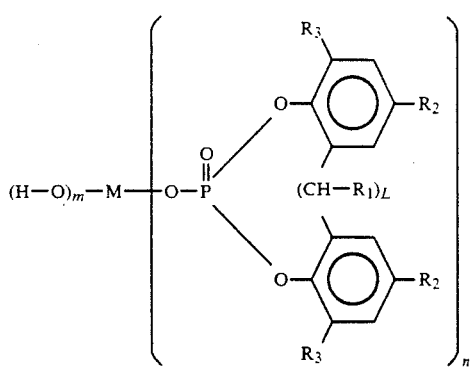

(I)

wherein $R_1$ represents a hydrogen atom or an alkyl group having 1 to 4 carbon atoms, $R^2$ and $R^3$ each represent a hydrogen atom or an alkyl group having 1 to 9 carbon atoms, M represents a hydrogen atom or a metal atom having a valence of 1 to 4, L represents 0 or 1, m represents a number of 0 to 1, n represents 1 or 2, and m+n represents the valence of the metal M.

2. A heat-sensitive recording material according to claim 1, wherein the metal salt of the organic phosphate or bisphenol or its basic salt is a salt of a Group II metal.

3. A heat-sensitive recording material according to claim 1, wherein the amount of the organic phosphate of bisphenol, its metal salt or its basic salt contained in the material is 0.1 to 10 parts by weight per part by weight of the coupling substance.

* * * * *